US006543634B1

(12) United States Patent
Parrinello

(10) Patent No.: US 6,543,634 B1
(45) Date of Patent: Apr. 8, 2003

(54) PLASTIC SCREW CAP WITH PILFERPROOF RING

(75) Inventor: Fiorenzo Parrinello, Medicina (IT)

(73) Assignee: Sacmi Cooperativa Meccanici Imola S.C.R.L., Imola (IT)

( * ) Notice: Subject to any disclaimer, the term of this patent is extended or adjusted under 35 U.S.C. 154(b) by 0 days.

(21) Appl. No.: 09/463,175

(22) PCT Filed: Jul. 21, 1998

(86) PCT No.: PCT/EP98/04539

§ 371 (c)(1),
(2), (4) Date: Mar. 23, 2000

(87) PCT Pub. No.: WO99/05039

PCT Pub. Date: Feb. 4, 1999

(30) Foreign Application Priority Data

Jul. 25, 1997 (IT) ..... BO97A0457

(51) Int. Cl.[7] ..... B65D 41/34
(52) U.S. Cl. ..... 215/252
(58) Field of Search ..... 215/252

(56) References Cited

U.S. PATENT DOCUMENTS 4,549,667 A * 10/1985 Dullabaun ..... 215/252
4,667,838 A * 5/1987 Yeager ..... 215/252
4,913,300 A * 4/1990 Wiedmer et al. ..... 215/252
5,107,998 A 4/1992 Zumbuhl
5,131,550 A * 7/1992 Thompson ..... 215/252
5,356,019 A * 10/1994 Kelly ..... 215/252
5,648,037 A * 7/1997 Franchet et al. ..... 215/252
5,680,945 A * 10/1997 Sander et al. ..... 215/252
5,979,682 A * 11/1999 Zumbuhl ..... 215/252
5,992,661 A * 11/1999 Zumbuhl ..... 215/252
6,068,151 A * 5/2000 Recendez ..... 215/252
6,123,025 A * 10/2000 Recendez ..... 215/252
6,213,321 B1 * 4/2001 Zumbuhl ..... 215/252
6,308,848 B1 * 10/2001 Parrinello ..... 215/252

FOREIGN PATENT DOCUMENTS

PL A-315 375 2/1997
WO A-94 18084 8/1994

* cited by examiner

*Primary Examiner*—Nathan J. Newhouse

(57) ABSTRACT

A plastic screw cap comprising a cylindrical cup provided with an internal thread and with a pilferproof ring which is connected to the rim of the cup by means of a plurality of bridges which form a circular fracture line, the ring having a plurality of internal flaps which are inclined towards the bottom of the cup; the pilferproof ring comprising a cylindrical wall, whose thickness is such that it is substantially flexible in a radial expansion direction, a rim which is connected to the rim of the cup by the bridges, and an opposite rim which is connected to an internal annular bead whose inside diameter is smaller than the inside diameter of the wall and whose thickness is significantly greater than the thickness of the wall, a plurality of flaps protruding from the region connecting the flexible wall and the internal annular bead and having such a thickness as to acquire substantial rigidity with respect to radial stresses.

4 Claims, 3 Drawing Sheets

PLASTIC SCREW CAP WITH PILFERPROOF RING

BACKGROUND OF THE INVENTION

The present invention relates to a plastic screw cap with pilferproof ring.

Such caps are already commercially available and comprise a cylindrical cup which is internally threaded in order to be screwed onto the top of the container (bottle). A so-called pilferproof ring is coupled to the rim of the tray by means of breakable bridges and is internally provided with engagement elements constituted by flaps which, when the cap is applied to close the container, engage below a retention collar of the container.

By unscrewing the cap, the flaps abut against the collar and retain the ring, while the consequent axial traction force breaks the bridges.

In conventional caps the problem is felt of ensuring that during application to the container the flaps can expand or otherwise deform to move beyond the retention collar of the bottle and then contract again below said collar, so as to allow the pilferproof ring to separate during unscrewing and clearly indicate that the container has been opened.

Currently commercially available caps suffer some substantial drawbacks which are due to the structure of the teeth and to the technical difficulties in providing them, also in view of the problems linked to the molding steps, particularly to the extraction of the caps from the mold.

U.S. Pat. No. 5,107,998 discloses a closure with a pilferproof ring having a radially inwardly directed flange and a plurality of internal flaps pivotally secured to the flange. The flaps, during positioning of the closure upon a threaded finish of a container engage a recess and during removal of the closure are pivoted to engage the upper surface of the flange.

SUMMARY OF THE INVENTION

The aim of the present invention is to provide a plastic cap which can substantially obviate the shortcomings of conventional caps.

This aim is achieved by a plastic screw cap for sealing a container having a threaded finish and a collar adjacent to said threaded finish, said cap comprising a cylindrical cup provided with an internal thread and with a pilferproof ring which is connected to the rim of the cup by means of a plurality of bridges which form a fracture line, said ring having a plurality of internal flaps which are inclined towards the bottom of the cup; characterized in that the pilferproof ring comprises a cylindrical wall, whose thickness is such that it is substantially flexible in a radial expansion direction, a rim which is connected to the rim of said cup by said bridges, and an opposite rim which is connected to an annular internal bead whose inside diameter is smaller than the inside diameter of said wall and whose thickness is significantly greater than the thickness of said wall; and in that a plurality of flaps protrude from the region connecting said flexible wall and said internal annular bead, said flaps having such a thickness as to acquire substantial rigidity with respect to radial stresses, so that during removal of the cap abutment of the flaps on said collar produces expansion of said bead at the region connected to said wall.

BRIEF DESCRIPTION OF THE DRAWINGS

Further characteristics and advantages of the present invention will become apparent from the following detailed description on the basis of the accompanying drawings, wherein.

DESCRIPTION OF THE PREFERRED EMBODIMENTS

Figure 1:
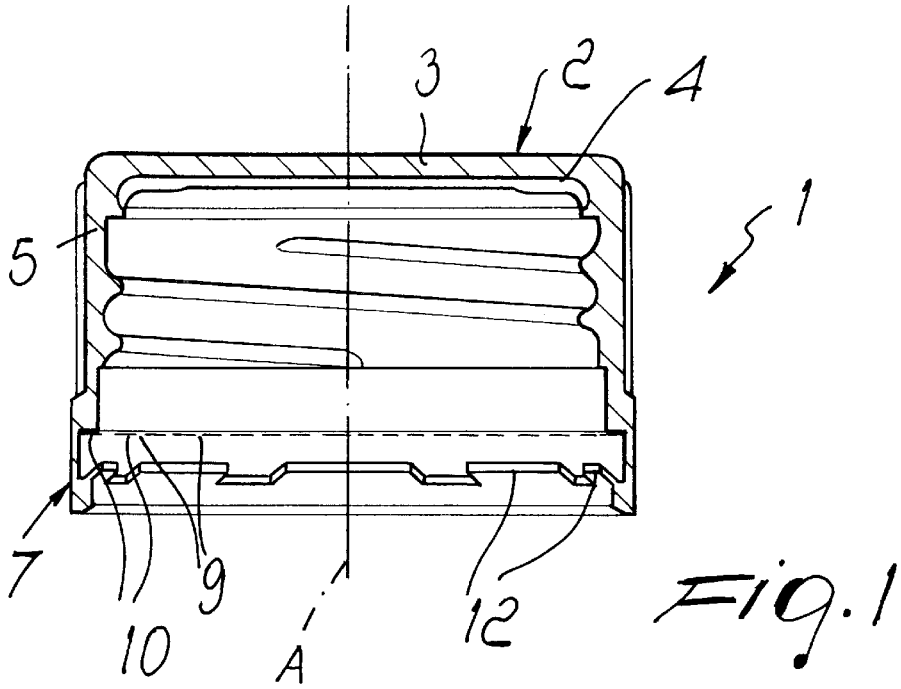
FIG. 1 is an axial sectional view of a screw cap according to a first embodiment.
Figure 2:
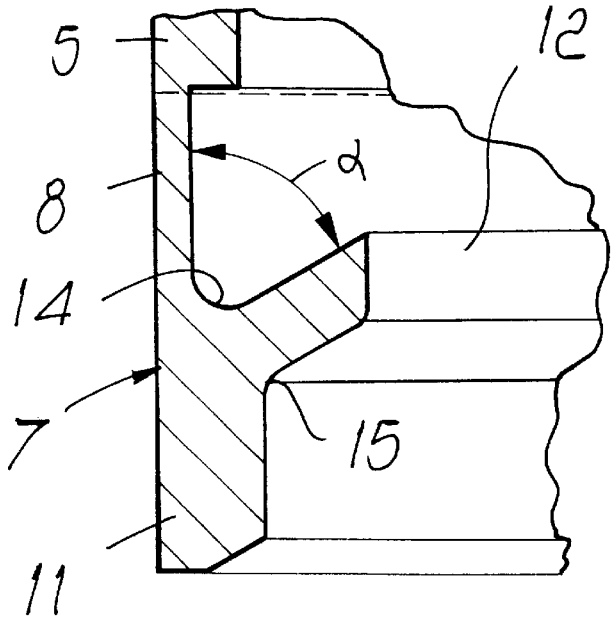
FIG. 2 is an enlarged-scale view of a detail of the cap of FIG. 1.
Figure 3:
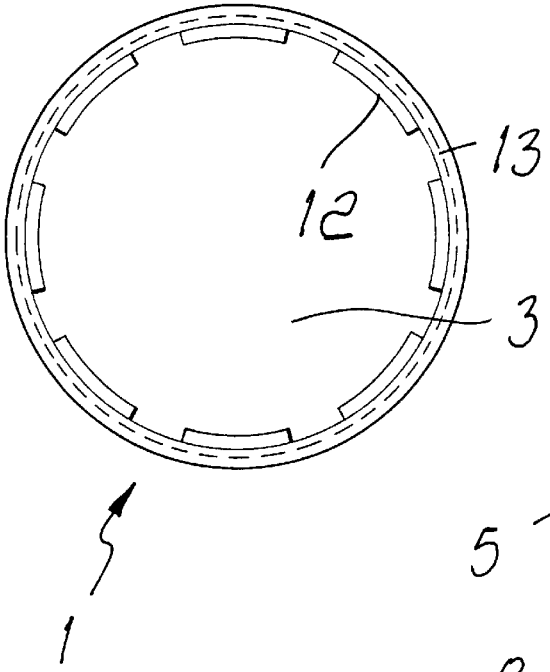
FIG. 3 is an axial view of the cap of FIG. 1.
Figure 4:
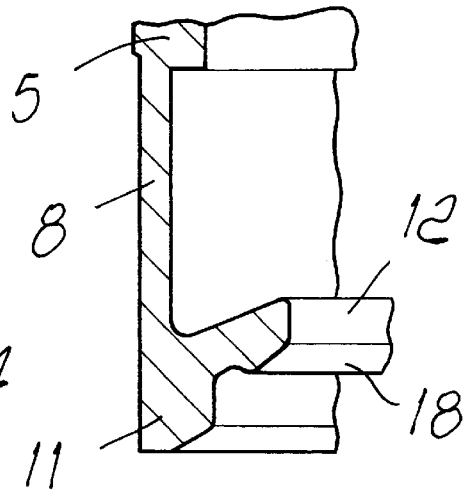
FIG. 4 is an enlarged-scale view of a detail of a cap according to a second embodiment.
Figure 5:
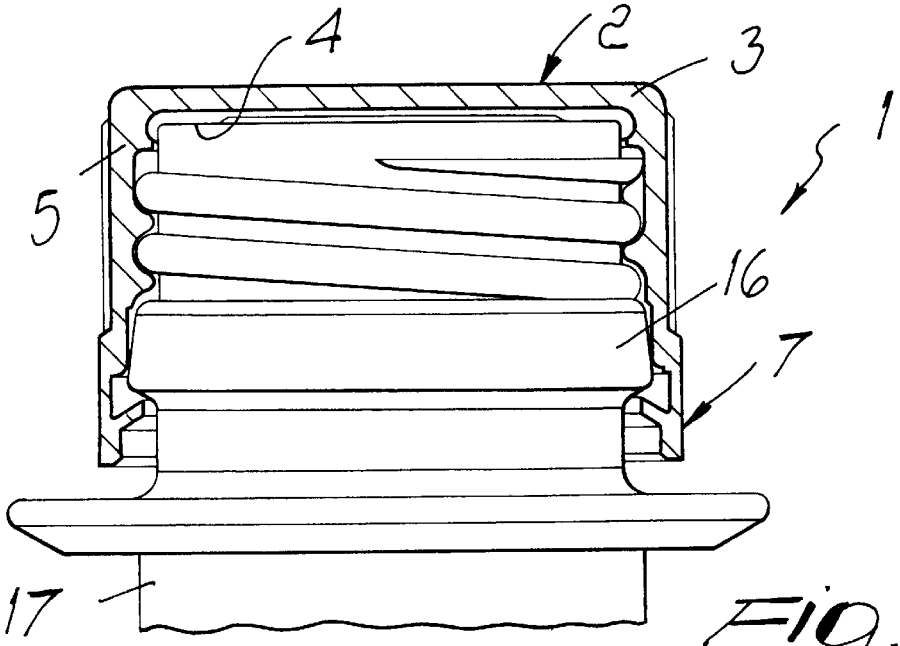
FIG. 5 is a view of a cap according to FIG. 1, applied to a container.

With reference to FIGS. 1, 2, 3 and 5, 1 generally designates a cap according to the present invention, which is formed by molding plastics according to known methods. The cap 1 comprises a cylindrical cup 2 which is composed of a bottom 3, which is internally covered by a liner 4, and of a cylindrical wall 5 inside which a thread 6 is formed.

A pilferproof ring 7 protrudes from the rim of the cylindrical wall 5 of the cup 2 and is composed of a cylindrical wall 8, in which one rim is connected to the rim of the cup 2 by means of a plurality of bridges 9 spaced by slits 10 and the opposite rim has an internal annular bead 11. The bridges 9 and the slits 10 can be provided in any manner, for example during the molding of the cap by providing suitable shapes of the mold or by cutting operations after molding.

The wall 8 has a significantly lower thickness than the wall 5 of the cup so that, by utilizing the elasticity of the plastic material, it can sustain any widening that occurs at the region for connection to the annular bead 11, in order to assume a conical shape which tapers towards the bottom of the cup during application to a container 17.

The bead 11 is significantly thicker than the wall 8 and protrudes from the inner face thereof, so that the inside diameter of the bead is significantly smaller than the inside diameter of the wall 8.

The greater thickness of the annular bead 11 ensures that said bead can widen less than the wall 8 with respect to the elasticity of the plastic material of which the cap is made.

The difference in inside diameter between the bead 11 and the wall 8 forms a step-like connecting region, from which a plurality of flaps 12 protrude towards the inside of the cup 2; said flaps are inclined towards the bottom 3 of the cup with an inclination $\alpha$ of approximately 60°. The flaps 12 are equidistant, are mutually separated by sectors 13, and are preferably thicker than the wall 8 but thinner than the bead 11. Moreover, the upper and lower faces of the flaps 12 are connected to the inner faces of the wall 8 and of the bead 11 by radiused regions 14, 15.

The different thicknesses of the wall 8, of the bead 11 and of the flaps 12 produce on the one hand easier application of the cap to the threaded finish of the container 17 and, on the other hand, firmer retention of the pilferproof ring 7 under the collar 16 of the container 17 to which the cap 1 is applied and, ultimately, a safer separation thereof when the cap is unscrewed.

Figure 6:
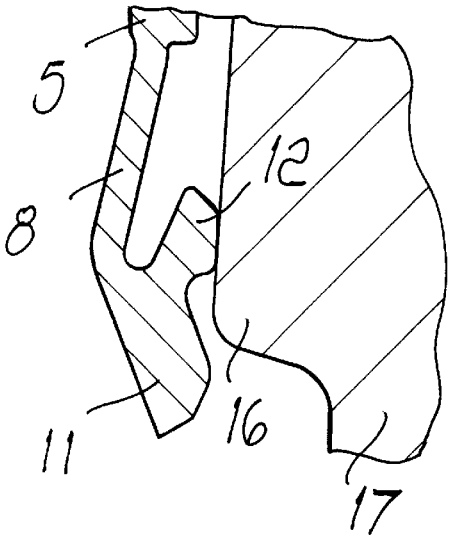
FIGS. 6 to 8 are views of the cap in successive steps of its application to a container.

As shown by FIG. 6, during the application of the cap 1 to the In container 17, the abutment of the flaps 12 on the collar 16 in fact produces a widening of the bead 11 to which the wall 8 is attached, while the diameter of the opposite edge of the bead 11 remains substantially unchanged.

Figure 7:
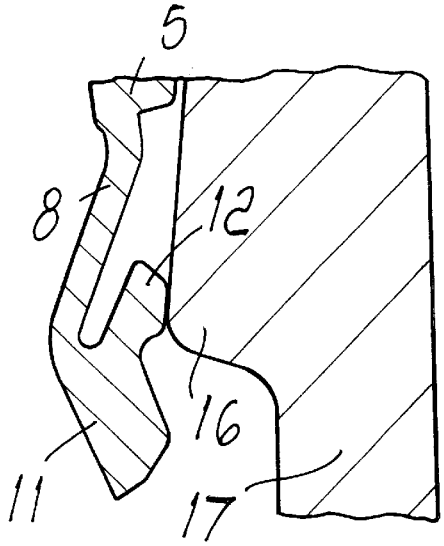

The wall 8, because of its greater flexibility, follows the widening of the bead 11 (see FIG. 7). In practice, the bead 11 undergoes torsion with respect to the axis A of the cap and therefore the ends of the flaps 12 and the lower edge of the bead 11 move onto a cylindrical plane which lies further outward than the natural resting plane and facilitates their sliding on the collar 16 of the container 17.

Figure 8:
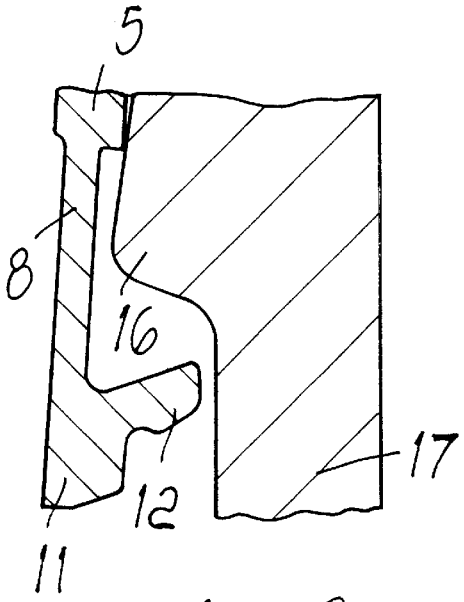

When the flaps 12 have moved below the collar 16, the elastic memory of the material ensures that the bead 11 and the flaps 12 substantially resume their natural position (see FIGS. 8 and 5), in which the flaps 12 protrude below the collar 16.

Figure 9:
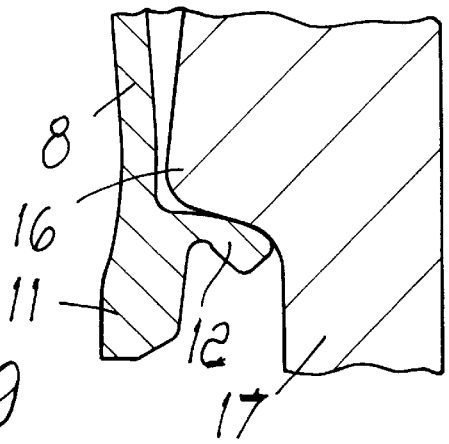
FIG. 9 is a view of the cap during unscrewing.

It should be noted that when the cap 1 is removed from the container 17, the flaps 12 abut under the collar 16 and, thanks to the flexibility of the wall 8, produce an inward folding of the rim of the bead 11 to which the wall 8 is connected. In this manner, the flaps 12 are moved towards the container 17, ensuring a more effective abutment of the flaps under the collar 16 and safer separation of the pilferproof ring 1. In this position, the angle between the flaps and the axis A of the cap during the breaking of the pilferproof ring is $\geqq 90°$(see FIG. 9).

It is evident that it is important that the flaps have a thickness which allows them to acquire, in accordance with the natural elasticity of the plastic material of which the cap is made, a substantial rigidity to radial stresses which allows torsional deformation of the bead and therefore the double orientation of the flaps in a position for sliding along the collar of the container during cap application and a position in which they have an interference fit below the collar during the unscrewing of said cap.

The described cap is susceptible of numerous modifications and variations.

With respect to FIG. 2, FIGS. 4, 6–9 illustrate an embodiment in which the flaps 12 are provided, in a downward region, with a stiffening tooth 18. As an alternative, the tooth can be provided on the upper face of the flaps.

In a different embodiment, the bead 11 has, at the intermediate sectors 13, a smaller cross-section than at the flaps 12, so as to affect the ability of the flaps 12 to widen outward. In the practical embodiment of the invention, the shapes and the dimensions, as well as the materials employed, may be any according to requirements.

The disclosures in Italian Patent Application No. BO97A000457 from which this application claims priority are incorporated herein by reference.

What is claimed is:

1. A plastic screw cap for sealing a container having a threaded finish and a collar adjacent to said threaded finish, said cap comprising a cylindrical cup provided with an internal thread; a rim; a pilferproof ring, with a plurality of bridges for connecting to the rim of the cylindrical cup said pilferproof ring, said plurality of bridges forming a circular fracture line, said pilferproof ring comprising a cylindrical wall having a first cross-sectional thickness such as to be substantially flexible in a radial expansion direction, a first upper rim which is connected to said rim of said cylindrical cup through said bridges, and a second opposite lower rim connected through a connection region to an internal annular bead with an inside diameter being smaller than an inside diameter of said cylindrical wall, said annular bead having a second cross-sectional thickness being significantly greater than the first thickness of said cylindrical wall; and wherein said ring further comprises: a plurality of flaps that protrude from said connection region connecting said flexible cylindrical wall and said internal annular bead, said flaps being inclined upwardly and having a third cross-sectional thickness being such as to impart to the flaps a rigidity such as to withstand, without flexing, radial stresses; and intermediate sectors for separating said flaps, said intermediate sectors having a cross-sectional thickness bigger than the first thickness of the flexible wall and smaller than the second thickness of said bead so that during inserting and removal of the cap the flaps abut on said collar without flexing, whereby to produce flexing of said ring only at the connection region where said flaps protrude.

2. The screw cap of claim 1, wherein said third thickness of said flaps is intermediate between the second thickness of said bead and the first thickness of said cylindrical wall.

3. The screw cap of claim 2, wherein each one of said flaps comprises a stiffening tooth on at least one face thereof.

4. The screw cap of claim 3, wherein said thickness of said intermediate sectors is such that the ring has a smaller cross-section at said sectors than at the flaps.

* * * * *